US005829744A

United States Patent [19]

Nelson

[11] Patent Number: 5,829,744

[45] Date of Patent: Nov. 3, 1998

[54] REPOSITIONABLE PUZZLE

[75] Inventor: Gunnard Leo Nelson, Stilwell, Kans.

[73] Assignee: Barton Nelson, Inc., Kansas City, Mo.

[21] Appl. No.: 840,786

[22] Filed: Apr. 16, 1997

[51] Int. Cl.[6] ..... A63F 9/10

[52] U.S. Cl. ..... 273/157 R; 273/153 R

[58] Field of Search ..... 273/157 R, 155, 273/156, 153 R; 434/171, 172, 193, 195, 403, 406, 428

[56] References Cited

U.S. PATENT DOCUMENTS

| | | | |
|---|---|---|---|
| 2,659,163 | 11/1953 | Albee | 273/157 R |
| 2,866,278 | 12/1958 | Snarr | 434/195 |
| 3,171,214 | 3/1965 | Sutherland | 273/157 R |
| 4,336,664 | 6/1982 | Penick et al. | 273/157 R |
| 4,811,951 | 3/1989 | Dorsey-Zinn et al. | 273/157 R |

*Primary Examiner*—Steven B. Wong

*Attorney, Agent, or Firm*—Armstrong, Teasdale, Schlafly & Davis

[57] ABSTRACT

A repositionable puzzle having a base, at least one removable piece having a first surface having a fastener adapted to releasably engage the base and a second surface having indicia. A panel is attached to the base. The panel has clue and answer indicia thereon. The at least one removable piece is moved on the base from a position adjacent to the answer indicia on the panel to a position adjacent to the corresponding clue indicia on the panel to complete the puzzle. A method of playing a puzzle game on a repositionable puzzle having a base, at least one removable piece having a first surface having a fastener adapted to releasably engage the base and a second surface having indicia, a panel attached to the base having clue and answer indicia thereon, the method includes the step moving the at least one removable piece on the base from a position adjacent to the answer indicia on the panel to a position adjacent to the clue indicia on the panel to complete the puzzle.

16 Claims, 5 Drawing Sheets

REPOSITIONABLE PUZZLE

FIELD OF THE INVENTION

This invention relates to games and more specifically, to a repositionable puzzle and a method of playing a puzzle game on a repositionable puzzle.

BACKGROUND OF THE INVENTION

Several puzzle games are designed for one-time use. In particular, some puzzle games are set-up so that as completed, the answers and solutions are permanently displayed. For example, various puzzle games include specific questions or clues which must be answered to solve the puzzles. In some of these commonly known puzzles, a player writes the answers directly on the puzzle while solving the puzzle. Thus, the next player must cover or erase the answers to receive the same challenge as the first player. Accordingly, these puzzles are frequently discarded after one use instead of being re-used a second time. In addition, some of the commonly-known puzzle games are designed to focus on the challenge aspect of the game, however, have minimal educational value. Moreover, some of the commonly-known puzzle games include pieces which do not releasably secure to their base and are therefore easily misplaced.

Accordingly, it is desirable and advantageous to provide a repositionable puzzle and a method of playing a puzzle game on a repositionable puzzle that is challenging and educational yet fun to play. It is also desirable and advantageous to provide a repositionable puzzle which is not expensive to manufacture, and that may be used repeatedly.

An object of the present invention is to provide a repositionable puzzle that may be solved and then re-used.

Another object of the present invention is to provide a repositionable puzzle that has educational value.

Yet another object of the present invention is to provide a repositionable puzzle that is easy and inexpensive to manufacture.

Still another object of the present invention is to provide a repositionable puzzle that has removable pieces which adhere to its base.

SUMMARY OF THE INVENTION

These and other objects are attained by a repositionable puzzle which in one embodiment includes a base and removable pieces which may be moved on the base to a different position and then replaced. The repositionable puzzle of the present invention is adapted to be solved and then re-used. The removable pieces of the repositionable puzzle are adapted to secure to a base. The repositionable puzzle includes a panel having clues and answers on its surface. The panel surrounds the removable pieces. The repositionable puzzle is solved by matching an answer on the panel adjacent to a particular removable piece with a corresponding clue on the panel. Once the answer and clue are matched, the removable piece is moved to a position adjacent to the clue thereby solving the puzzle which in one embodiment completes a picture. Generally, the repositionable puzzle of this invention comprises a base, at least one removable piece having a first surface having a fastener adapted to releasably engage the base and a second surface having indicia, and a panel attached to the base having clue and answer indicia thereon. The at least one removable piece is moved from a position adjacent to the answer indicia to a position adjacent to the clue indicia on the panel to complete the puzzle. In one embodiment the repositionable puzzle includes several removable pieces which each have a first surface with fasteners adapted to releasably engage the base and a second surface having indicia, and various clue indicia and answer indicia located on the surface of the panel. Each of the removable pieces corresponds to at least one clue indicia and at least one answer indicia on the panel. The removable pieces are moved from a position adjacent to its answer question indicia to a position adjacent to its corresponding clue indicia. The second surface indicia of each of the removable pieces completes a puzzle when the piece is positioned adjacent to its corresponding clue indicia on the base. A method of playing a puzzle game on a repositionable puzzle having a base, at least one removable piece having a first surface with a fastener adapted to releasably engage the base and a second surface having indicia, a panel attached to the base having clue and answer indicia thereon, including a step of moving a removable piece on the base from a position adjacent to its answer indicia on the panel to a position adjacent to its corresponding clue indicia on the panel to complete the puzzle.

The repositionable puzzle of the present invention provides repositionable puzzle wherein the removable pieces adhere to the base and are moved from a position adjacent to answer indicia on a panel to a position adjacent to clue indicia on the panel to complete the puzzle. The repositionable puzzle is easy and inexpensive to manufacture and provides a fun challenging method of learning.

These and other features and advantages will be in part apparent, and in part pointed out hereinafter.

DETAILED DESCRIPTION OF THE PREFERRED EMBODIMENTS

Figure 1:
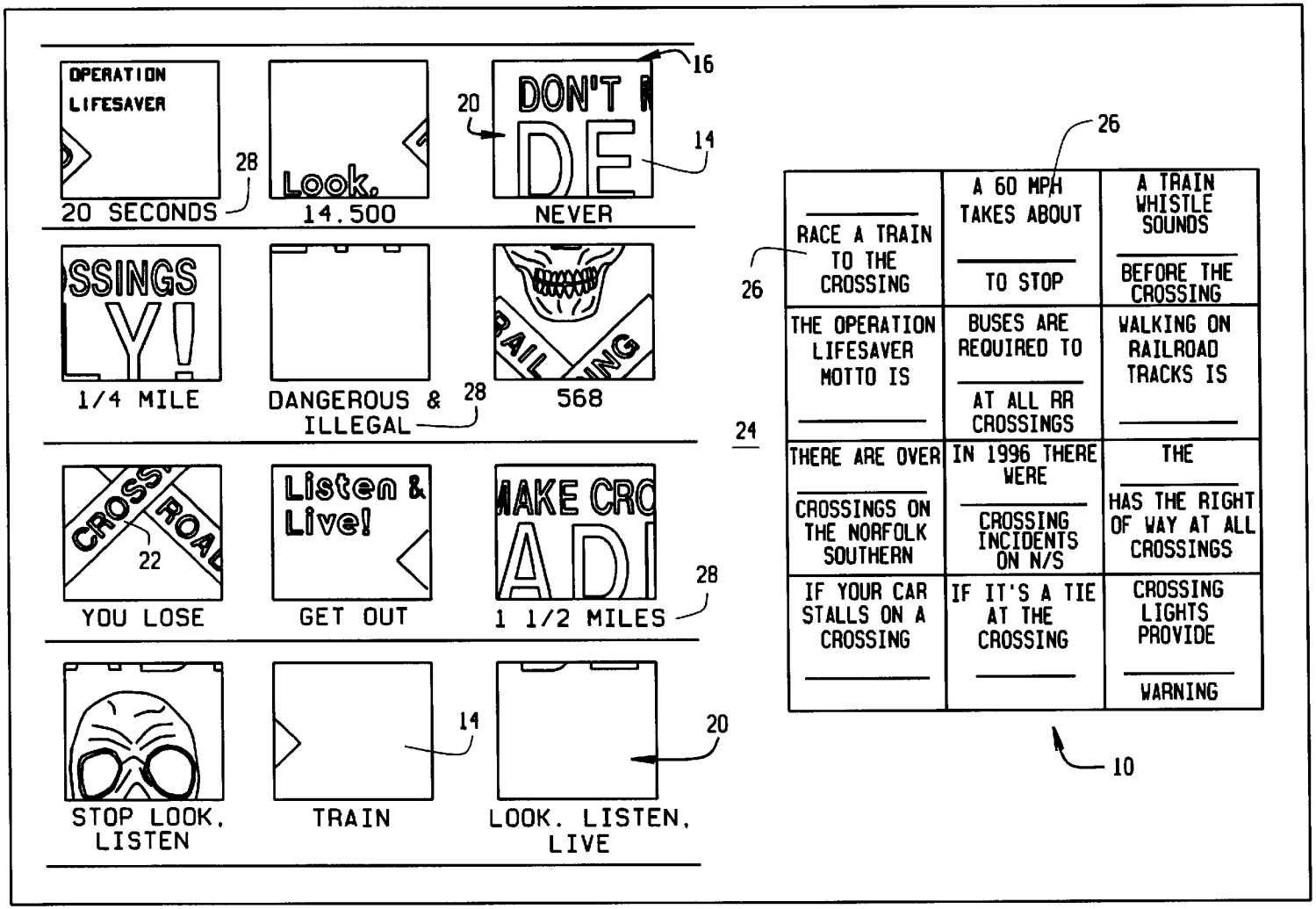
FIG. 1 is a top plan view of the first embodiment of the invention according to the principles of this invention.

A first embodiment of a repositionable puzzle constructed according to the principles of this invention, is indicated generally as 10 in FIGS. 1–5. FIG. 1 is a top plan view of the first embodiment of the repositionable puzzle 10. Particularly, repositionable puzzle 10 includes a base 12, (shown in FIG. 2) and at least one removable piece 14 having a first surface 16 having a fastener 18 adapted to releasably engage base 12 and a second surface 20 having indicia 22. Base 12 is made from various different materials suitable for receiving and supporting removable piece 14. In addition, repositionable puzzle 10 includes a panel 24 attached to base 12. Panel 24 includes clue indicia 26 and answer indicia 28 thereon. Panel 24 surrounds removable piece 14 on base 12.

In one embodiment base 12 is made from the backing of a repositionable adhesive, such as the type available at Barton Nelson, Inc. of Kansas City, Mo. 64145. In the one embodiment, a repositionable adhesive, available at Barton Nelson, Inc., has a backing and a top layer. The top layer has a first surface covered with the repositionable adhesive layer and a second surface adapted for displaying indicia such as advertising, information, etc. The top layer is attached to the backing by placing the first repositionable adhesive surface face down toward the backing. In this embodiment, removable piece 14 is cut through the top layer and the backing is used as base 12. Moreover, the second surface of the top layer remaining after removable piece 14 is cut out forms panel 24.

Figure 2:
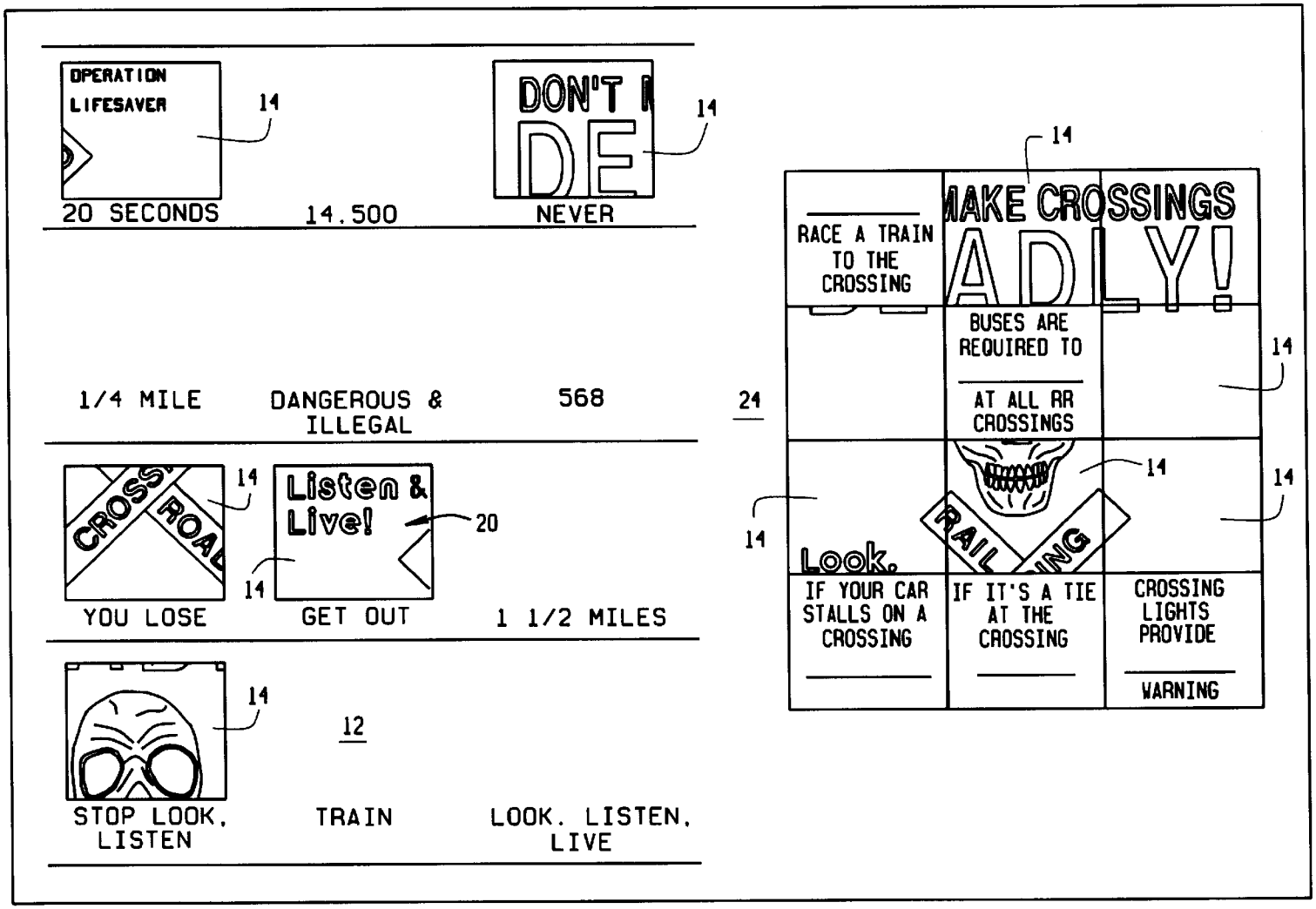
FIG. 2 is a top plan view of the first embodiment showing the puzzle partially completed.

FIG. 2 is a top plan view of the first embodiment showing repositionable puzzle 10 partially completed. In one embodiment repositionable puzzle 10 includes several removable pieces 14. Each piece 14 has a first surface 16 having a fastener 18. Fastener 18 is adapted to releasably engage base 12. As discussed previously, fastener 18 is preferably a repositionable adhesive so that piece 14 may be moved from one spot to another on base 12. Each piece 14 also has a second surface 20 having various indicia 22, as discussed more fully below.

Figure 3:
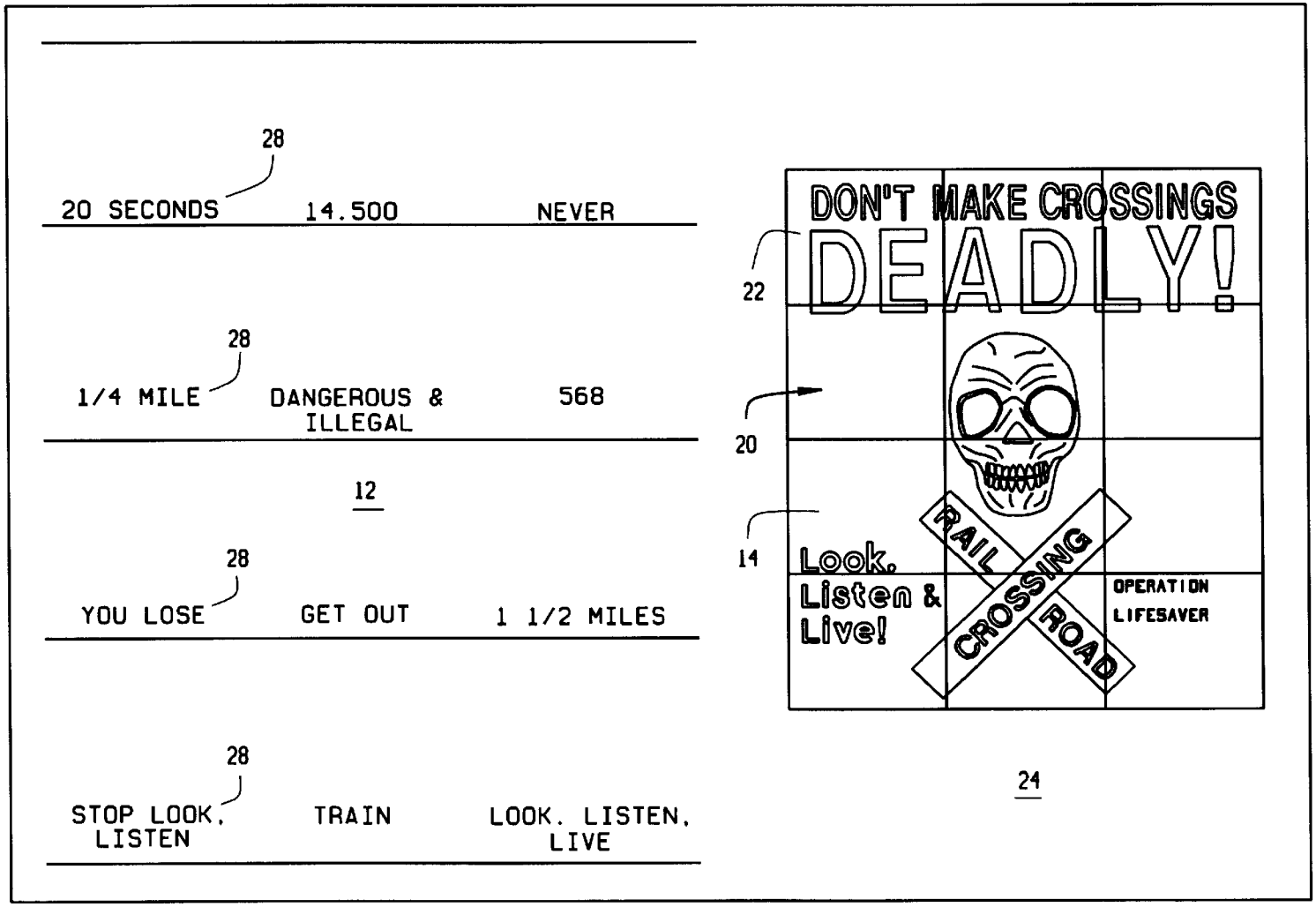
FIG. 3 is a top plan view of the first embodiment showing the completed puzzle.

As illustrated in FIG. 3, indicia 22 align on base 12 of repositionable puzzle 10 to form a completed puzzle. In particular, the indicia 22 on second surface 20 forms a completed puzzle when the clues and answers are correctly matched so that pieces 14 are properly arranged on base 12 adjacent to corresponding clues. The particular design formed by correctly matching clue indicia and answer indicia and thereby moving removable pieces 14 whereby surface indicia 22 complete the puzzle is not critical. The designs could depict several different scenes or messages. In addition, the designs are educational and include several topics for example, recycling awareness, safety and geography. In the one embodiment, clue indicia 26 and answer indicia 28 are located on opposite sides of panel 24 so that the completed puzzle is formed on one side of base 12.

Figure 4:
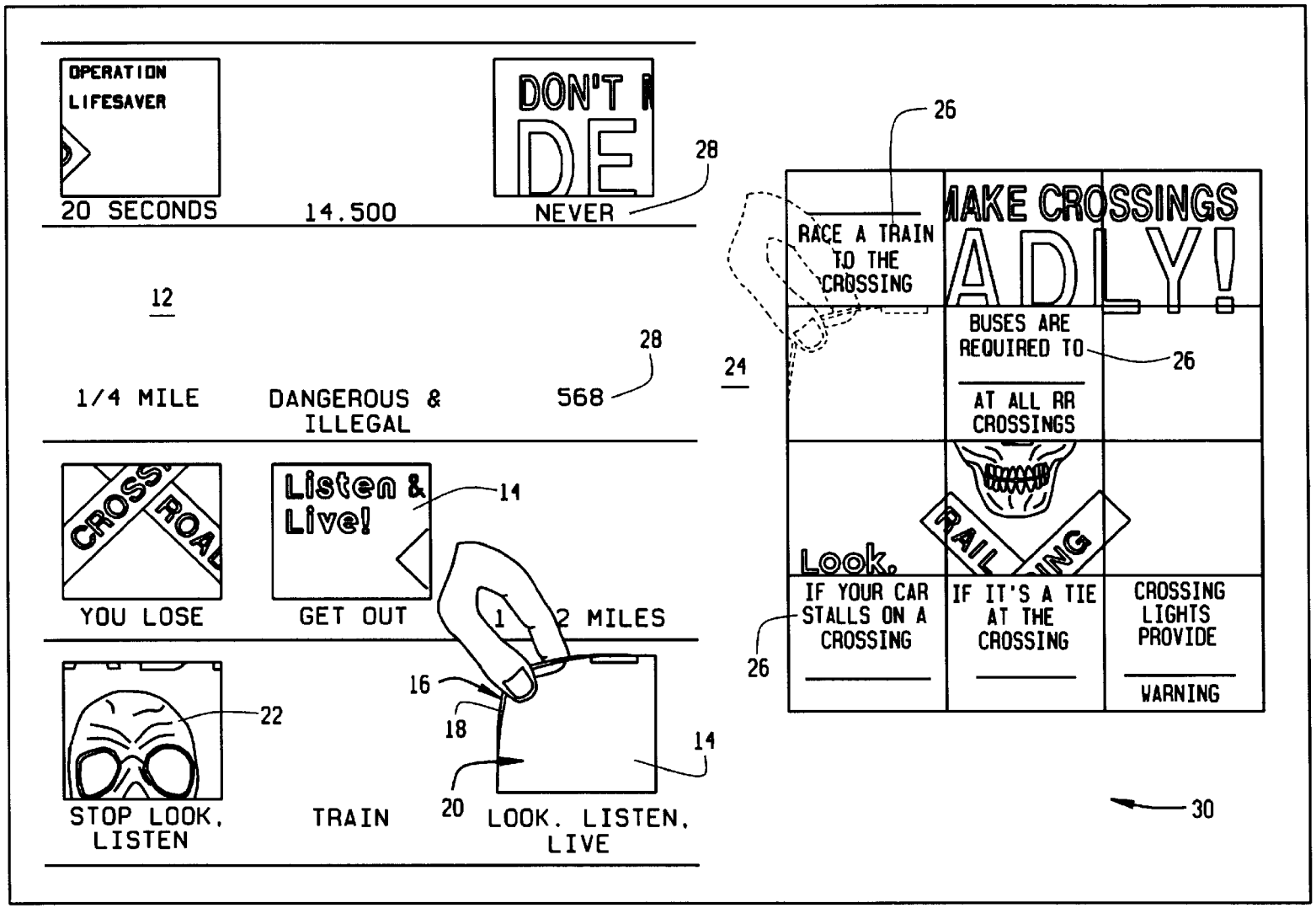
FIG. 4 is a top plan view of the first embodiment showing a player's hand moving a removable piece.
Figure 5:
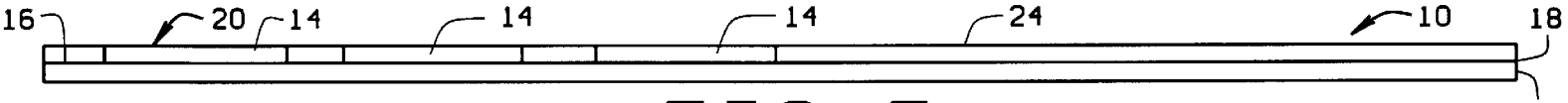
FIG. 5 is a top plan view of the first embodiment.

FIG. 4 illustrates a top plan view of the first embodiment of repositionable puzzle 10. In the one embodiment, panel 24 includes several clue indicia 26 and several answer indicia 28 located on the surface of panel 24. Each of removable pieces 14 is placed at a predetermined location on base 12 so that it corresponds to at least one clue indicia 26 and at least one of answer indicia 28. For example, each clue indicia 26 on panel 24 matches an answer indicia 28. Matching clue indicia 26 with the corresponding answer indicia 28 reveals where corresponding piece 14 is placed to solve the puzzle. In particular, each removable piece 14 is moved on base 12 from a position adjacent to its corresponding answer indicia 28 to a position adjacent to its corresponding clue indicia 26. Second surface indicia 22 of each removable piece 14 forms a completed puzzle 10 when positioned adjacent to its corresponding clue indicia 26 on base 12. After repositionable puzzle 10 is completed, removable pieces 14 are moved back from the position adjacent to clue indicia 26 to a position adjacent to answer indicia 28 on panel 24 to disperse the completed puzzle so that the puzzle may be re-used. Panel 24 also includes spacing 30 suitable for displaying information such as advertising indicia (not shown).

As mentioned previously, in the one embodiment, removable pieces 14 are cut out of the top layer of the repositionable adhesive leaving the backing as base 12. Thus, as shown in the side view of FIG. 5, before the puzzle is completed puzzle 10 is relatively flush across its top surface.

Figure 6:
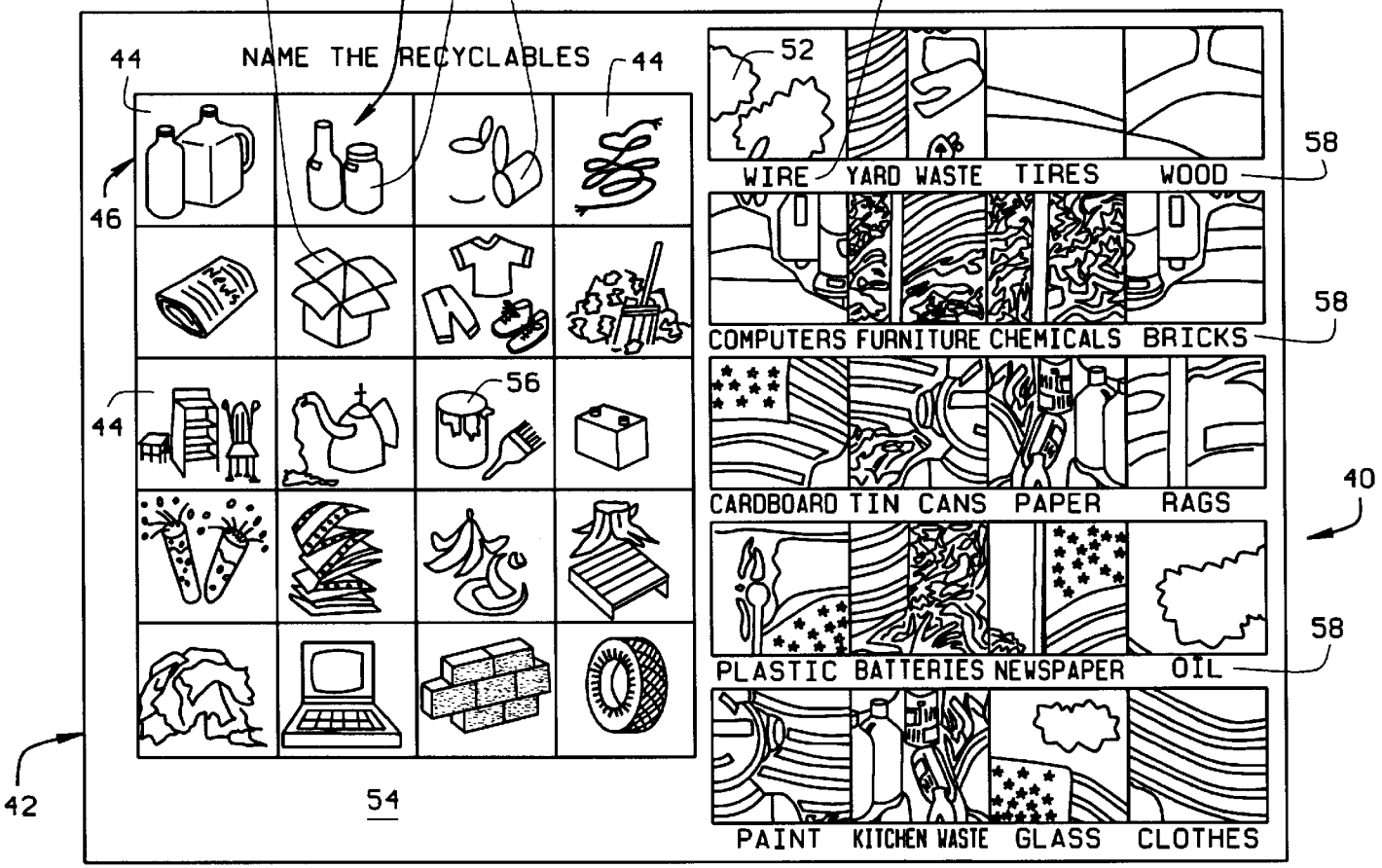
FIG. 6 is a top plan view of a second embodiment according to the principles of this invention.

FIG. 6 illustrates a top plan view of a second embodiment according to the principles of this invention. A repositionable puzzle 40 includes a base 42 and several removable pieces 44. Each piece 44 has a first surface 46 having fasteners 48 (not shown) adapted to releasably engage base 42. Fasteners 48 preferably comprise a repositionable adhesive. Each piece 44 has a second surface 50 having indicia 52. Base 42 is made from various different materials suitable for receiving and supporting removable piece 44. In addition, repositionable puzzle 40 includes a panel 54 attached to base 42. Panel 54 includes clue indicia 56 and answer indicia 58 thereon. Clue indicia 56 comprises pictures which correspond to answer indicia 58.

In the second embodiment, base 42 is preferably made from the backing of a repositionable adhesive, and pieces 44 are cut from the top layer of the repositionable adhesive, such as the type available at Barton Nelson, Inc. of Kansas City, Mo. 64145. However, several other materials could be used. As discussed previously, the repositionable adhesive has a backing and a top layer. The top layer has a first surface covered with the repositionable adhesive layer and a second surface adapted for displaying indicia such as advertising, information, etc. The top layer is attached to the backing by placing the first surface face down toward the backing. In this embodiment, removable piece 44 is cut through the top layer and the backing is used as base 42. Moreover, the second surface of the top layer forms panel 54.

Repositionable puzzle 50 has a plurality of clue indicia 56 and a plurality of answer indicia 58 on panel 54. Each removable piece 44 corresponds to at least one of the plurality of clue indicia 56 and at least one of the plurality of answer indicia 58 on panel 54. Removable pieces 44 are moved on base 42 from a position adjacent to its at least one answer indicia 58 to a position adjacent to its at least one corresponding clue indicia 56. Second surface indicia 52 of removable pieces 44 completes a puzzle when positioned adjacent to its at least one corresponding clue indicia 56 on base 42.

In another embodiment, the repositionable puzzle 10 or 40 includes a removable piece (not shown) that may be removed and worn as a badge.

IN OPERATION

In the first embodiment, removable piece 14 is moved on base 12 from a position adjacent to clue indicia 26 to a position adjacent to answer indicia 28 on panel 24 to complete the puzzle. The fasteners 18 releasably engage base 12 and are easily removed from one position and secured to base 12 at another position. Each second surface indicia 22 of removable pieces 14 forms a completed puzzle when positioned adjacent to its at least one corresponding clue indicia 26. After puzzle 10 is completed, removable pieces 14 may be moved from a position on panel 24 adjacent to clue indicia 26 to a position adjacent to answer indicia 28.

In the second embodiment, removable pieces 44 are moved on base 42 from a position adjacent to clue indicia 56 to a position adjacent to answer indicia 58 on panel 54 to complete the puzzle. The fasteners 48 releasably engage base 42 and are easily removed from one position and secured to base 42 at another position. Each second surface indicia 52 of removable pieces 44 forms a completed puzzle when positioned adjacent to its at least one corresponding clue indicia 56. After puzzle 40 is completed, removable pieces 44 may be moved from a position on panel 54 adjacent to clue indicia 56 to a position adjacent to answer indicia 58.

From the preceding descriptions of several embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by terms of the appended claims.

We claim:

1. A repositionable puzzle comprising:

a base;

at least one removable piece having a first surface having a fastener adapted to releasably engage the base and a second surface having indicia; and a panel attached to the base having at least one clue indicia and at least one answer indicia thereon, wherein each at least one removable piece corresponds to at least one of the clue indicia and at least one of the answer indicia on the panel;

whereby each at least one removable piece is configured to be moved from a position adjacent to its at least one answer indicia to a position adjacent to its at least one clue indicia, whereby a puzzle is completed by the second surface indicia after each of the removable pieces are positioned adjacent to their corresponding clue indicia on the panel.

2. The repositionable puzzle of claim 1 wherein the repositionable puzzle further comprises a plurality of removable pieces each having a first surface having fasteners adapted to releasably engage the base and a second surface having indicia, and a plurality of clue indicia and a plurality of answer indicia on the panel, wherein each of the removable pieces corresponds to at least one of the plurality of clue indicia and at least one of the plurality of answer indicia on the panel, whereby each of the removable pieces are moved on the base from a position adjacent to its at least one answer indicia to a position adjacent to its at least one corresponding clue indicia; whereby the second surface indicia of each of the removable pieces completes a puzzle when positioned adjacent to its at least one corresponding clue indicia on the base.

3. The repositionable puzzle of claim 2 wherein the fasteners are repositionable adhesive.

4. The repositionable puzzle of claim 2 wherein the repositionable puzzle further comprises a removable piece that may be removed and worn as a badge.

5. The repositionable puzzle of claim 2 wherein the clue and answer indicia are on opposite sides of the panel.

6. The repositionable puzzle of claim 2 wherein the panel includes advertising indicia.

7. A repositionable puzzle comprising:

at least one removable piece having a first surface coated with a repositionable adhesive and a second surface having indicia;

a base having a surface adapted to receive the first surface of the at least one removable piece; and a panel attached to the base having at least one clue indicia and at least one answer indicia thereon, wherein each at least one removable piece corresponds to at least one of the clue indicia and at least one of the answer indicia on the panel;

whereby each at least one removable piece is configured to be moved from a position adjacent to its at least one answer indicia to a position adjacent to its at least one clue indicia, whereby a puzzle is completed by the second surface indicia after each of the removable pieces are positioned adjacent to their corresponding clue indicia on the panel.

8. The repositionable puzzle of claim 7 further comprising a plurality of removable pieces each having a first surface covered with a repositionable adhesive and a second surface having indicia, and a plurality of clue indicia and a plurality of answer indicia on the panel, wherein each of the removable pieces corresponds to at least one of the plurality of clue indicia and at least one of the plurality of answer indicia on the panel, whereby each of the removable pieces are moved on the base from a position adjacent to its at least one answer indicia to a position adjacent to its at least one corresponding clue indicia; whereby the second surface indicia of each of the removable pieces completes a puzzle when positioned adjacent to its at least one corresponding clue indicia on the base.

9. The repositionable puzzle of claim 8 wherein the repositionable puzzle further comprises a removable piece that may be removed and worn as a badge.

10. The repositionable puzzle of claim 8 wherein the clue and answer indicia are on opposite sides of the panel.

11. The repositionable puzzle of claim 8 wherein the panel includes advertising indicia.

12. A method of playing a puzzle game on a repositionable puzzle having a base, at least one removable piece having a first surface having a fastener adapted to releasably engage the base and a second surface having indicia, a panel attached to the base having at least one clue indicia and at least one answer indicia thereon, wherein each at least one removable piece corresponds to at least one of the clue indicia and at least one of the answer indicia on the panel, the method comprising a step of:

moving each at least one removable piece on the base from a position adjacent to its at least one answer indicia on the panel to a position adjacent to its at least one clue indicia on the panel, whereby a puzzle is completed by the second surface indicia after the removable pieces are positioned adjacent to their clue indicia on the panel.

13. The method of claim 12 wherein the repositionable puzzle further comprises a plurality of removable pieces each having a first surface having fasteners adapted to releasably engage the base and a second surface having indicia, and a plurality of clue indicia and a plurality of answer indicia on the panel, wherein each of the removable pieces corresponds to at least one of the plurality of clue indicia and at least one of the plurality of answer indicia on the panel, whereby the method further comprise moving each of the removable pieces on the base from a position adjacent to its at least one answer indicia to a position adjacent to its at least one corresponding clue indicia; whereby the second surface indicia of each of the removable pieces completes a puzzle when positioned adjacent to its at least one corresponding clue indicia on the base.

14. The method of claim 13 wherein the fasteners are repositionable adhesive.

15. The method of claim 13 wherein the repositionable puzzle further comprises a removable badge piece, the method further comprising removing the removable badge piece and attaching it to a player.

16. A method of playing a puzzle game on a repositionable puzzle having a plurality of removable pieces each having a first surface covered with a repositionable adhesive and a second surface having indicia, a base having a surface adapted to receive the first surface of the removable pieces, and a panel attached to the base having clue and answer indicia thereon, wherein each of the removable pieces corresponds to at least one of the clue indicia and at least one of the answer indicia on the panel, the method comprising a step of:

moving each of the removable pieces on the base from a position adjacent to its answer indicia on the panel to a position adjacent to its corresponding clue indicia on the panel, to complete a puzzle by positioning the second surface indicia of each of the removable pieces adjacent to their corresponding clue indicia on the panel.

* * * * *